US008988451B2

(12) United States Patent
Han et al.

(10) Patent No.: US 8,988,451 B2
(45) Date of Patent: Mar. 24, 2015

(54) DISPLAY APPARATUS AND IMAGE CORRECTION METHOD OF THE SAME

(75) Inventors: Young-ran Han, Suwon-si (KR); Ji-yong Park, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 552 days.

(21) Appl. No.: 12/960,673

(22) Filed: Dec. 6, 2010

(65) Prior Publication Data

US 2012/0038660 A1 Feb. 16, 2012

(30) Foreign Application Priority Data

Aug. 12, 2010 (KR) ..... 10-2010-0077783

(51) Int. Cl.
*G09G 5/02* (2006.01)
*G09G 5/00* (2006.01)
*G09G 3/20* (2006.01)

(52) U.S. Cl.
CPC ..... *G09G 3/2003* (2013.01); *G09G 2300/026* (2013.01); *G09G 2320/0233* (2013.01); *G09G 2320/0242* (2013.01); *G09G 2360/145* (2013.01)
USPC ..... 345/590; 345/606

(58) Field of Classification Search
CPC ..... G09G 2300/026; G09G 2320/0233; G09G 2320/0242; G09G 2360/145; G09G 3/2003
See application file for complete search history.

(56) References Cited

U.S. PATENT DOCUMENTS 6,020,868 A * 2/2000 Greene et al. ..... 345/88
2005/0275912 A1* 12/2005 Chen et al. ..... 358/523
2010/0033489 A1* 2/2010 Elliott ..... 345/522

* cited by examiner

*Primary Examiner* — Kee M Tung
*Assistant Examiner* — Frank Chen
(74) *Attorney, Agent, or Firm* — Sughrue Mion, PLLC

(57) ABSTRACT

A display apparatus and an image correction method of the same are disclosed. The display apparatus includes a plurality of display panels; a sensing unit which senses a display characteristic of an image displayed on the display panels; and an image correction unit which generates non-uniformity correction data corresponding to a plurality of areas included in each of the display panels based on the display characteristic, interpolates non-uniformity correction data corresponding to a boundary area being in contact with a different display panel using non-uniformity correction data corresponding to a neighbor area adjacent to the boundary area, and corrects the image displayed on the display panels based on the generated and interpolated non-uniformity correction data.

18 Claims, 6 Drawing Sheets

DISPLAY APPARATUS AND IMAGE CORRECTION METHOD OF THE SAME

CROSS-REFERENCE TO RELATED APPLICATION

This application claims priority from Korean Patent Application No. 10-2010-0077783, filed on Aug. 12, 2010 in the Korean Patent Office, the disclosure of which is incorporated herein by reference.

BACKGROUND

1. Field

Apparatuses and methods consistent with the exemplary embodiments relate to a display apparatus and an image correction method of the same, and more particularly, to a display apparatus which includes a plurality of display panels and an image correction method of the same.

2. Description of the Related Art

While existing outdoor advertising provides simple content, a large format display (LFD) system enables display of various content and dynamic moving images with aggressive adoption of a liquid crystal display (LCD) panel or plasma display panel (PDP). The LFD system attracts attention as a next-generation display item to bring about changes in advertising industries and paradigms. The LFD system employs different technology from an LCD panel or PDP used for a television. That is, a television is for individuals and viewed by individuals for a long time, and thus advanced image-quality technologies to improve moving images, to represent natural colors, and the like are applied. However, an LFD is generally installed indoors or outdoors in bright surroundings such as in public places or shops, and may need multi-display technologies using a plurality of digital information displays depending on applications.

SUMMARY

Accordingly, one or more exemplary embodiments provide a display apparatus including a plurality of display panels to improve uniformity of an image and an image correction method of the same.

Further, one or more exemplary embodiments also provide a display apparatus to improve a color difference and a brightness difference between a plurality of display panels and an image correction method of the same.

According to an aspect of an exemplary embodiment, there is provided a display apparatus including: a plurality of display panels which are arranged adjacently; a sensing unit which senses a display characteristic of an image displayed on the display panels; and an image correction unit which generates non-uniformity correction data corresponding to a plurality of areas included in each of the display panels based on the display characteristic, interpolates non-uniformity correction data corresponding to a boundary area being in contact with a different display panel using non-uniformity correction data corresponding to a neighbor area adjacent to the boundary area, and corrects the image displayed on the display panels based on the generated and interpolated non-uniformity correction data.

The non-uniformity correction data may include at least one of color correction data and brightness correction data, the color correction data correcting a color difference of the image displayed on the display panels and the brightness correction data correcting a brightness difference of the image displayed on the display panels.

The color correction data may comprise a 3×3 matrix to convert a color characteristic of an input image into a predetermined target value.

The sensing unit may sense a color coordinate and a color temperature of each of the display panels, and the image correction unit may set the most frequent color coordinate and the most frequent color temperature, or an average color coordinate and an average color temperature among the sensed color coordinates and the sensed color temperatures as the target value.

The color correction data may include a lookup table to convert a color characteristic of an input image one to one.

The brightness correction data may include a coefficient to convert a brightness of an input image into a predetermined target value.

The image correction unit may interpolate the non-uniformity correction data corresponding to the boundary area based on a relative position between the boundary area and the neighbor area.

According to an aspect of another exemplary embodiment, there is provided an image correction method of a display apparatus which includes a plurality of display panels arranged adjacently, the method including: sensing a display characteristic of an image displayed on the display panels; generating non-uniformity correction data corresponding to a plurality of areas included in each of the display panels based on the display characteristic; interpolating non-uniformity correction data corresponding to a boundary area being in contact with a different display panel using non-uniformity correction data corresponding to a neighbor area adjacent to the boundary area; and correcting the image displayed on the display panels based on the generated and interpolated non-uniformity correction data.

The generating the non-uniformity correction data may include at least one of generating color correction data and generating brightness correction data, the color correction data correcting a color difference of the image displayed on the display panels and the brightness correction data correcting a brightness difference of the image displayed on the display panels.

The generating the non-uniformity correction data may include generating a 3×3 matrix to convert a color characteristic of an input image into a predetermined target value.

The sensing the display characteristic may include sensing a color coordinate and a color temperature of each of the display panels, and the generating the non-uniformity correction data may include setting the most frequent color coordinate and the most frequent color temperature, or an average color coordinate and an average color temperature among the sensed color coordinates and the sensed color temperatures as the target value.

The generating the non-uniformity correction data may include generating a lookup table to convert a color characteristic of an input image one to one.

The generating the non-uniformity correction data may include generating a coefficient to convert a brightness of an input image into a predetermined target value.

The interpolating the non-uniformity correction data may interpolate the non-uniformity correction data corresponding to the boundary area based on a relative position between the boundary area and the neighbor area.

BRIEF DESCRIPTION OF THE DRAWINGS

The above and/or other aspects will become apparent and more readily appreciated from the following description of the exemplary embodiments, taken in conjunction with the accompanying drawings, in which.

DETAILED DESCRIPTION OF EXEMPLARY EMBODIMENTS

Figure 1:
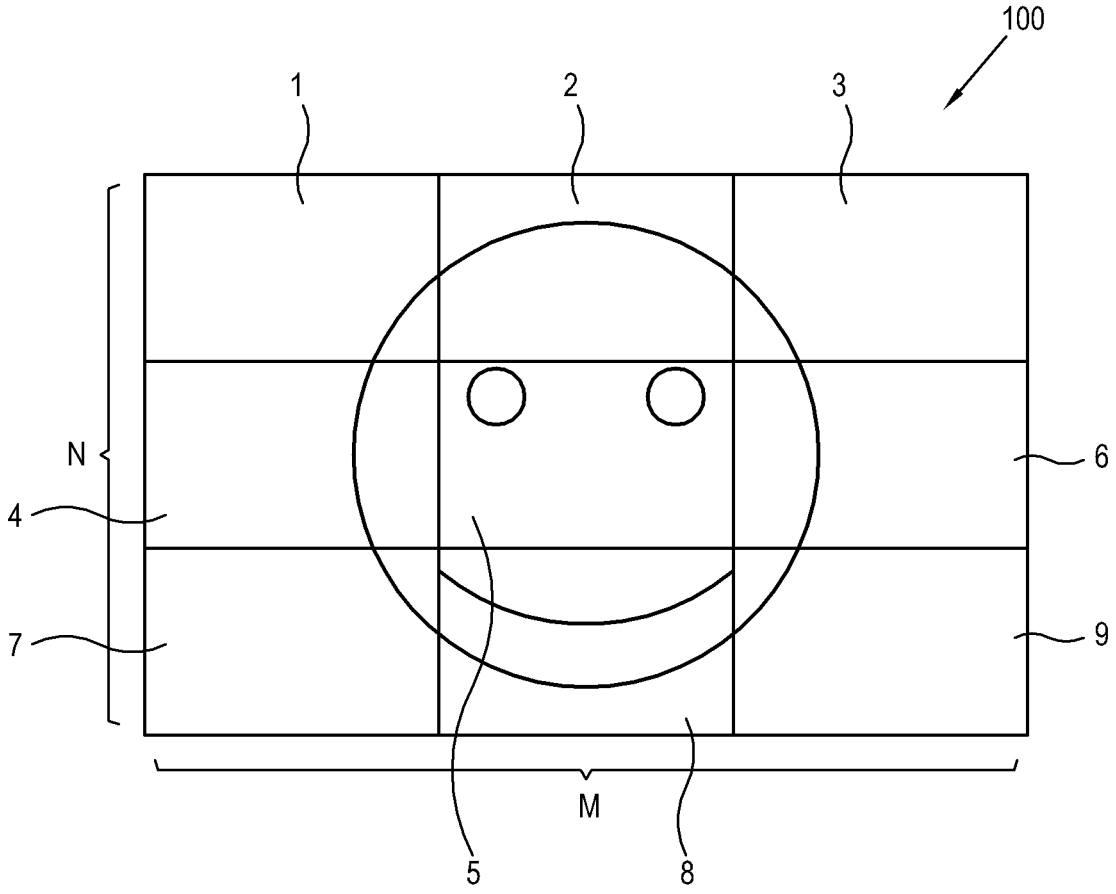
FIG. 1 illustrates a display apparatus including a plurality of display panels according to an exemplary embodiment.

Below, exemplary embodiments will be described in detail with reference to accompanying drawings so as to be easily realized by a person having ordinary knowledge in the art. The exemplary embodiments may be embodied in various forms without being limited to the exemplary embodiments set forth herein. Descriptions of well-known parts are omitted for clarity, and like reference numerals refer to like elements throughout.

FIG. 1 illustrates a display apparatus including a plurality of display panels according to an exemplary embodiment. As shown in FIG. 1, the display apparatus 100 includes a plurality of display panels 1 to 9. Display panels may be arranged in an M×N matrix form in a grid shape, and FIG. 1 shows the nine display panels 1 to 9 arranged in a 3×3 configuration. The display apparatus 100 may be realized as a large format display (LFD) system installed indoors or outdoors in bright surroundings such as in public places or shops for outdoor advertising. The same image or different images are displayed on the display panels 1 to 9 irrespective of the display panel 1 to 9, but a single image is displayed over the display panels 1 to 9 as shown in FIG. 1. Generally, an advertisement to be viewed by a plurality of people may be displayed as a still image or replayed as a moving image. The LFD system which attracts attention as a next-generation display item includes a plurality of display panels 1 to 9 arranged to be connected with each other, and thus there is a need for uniformity of image display characteristics, for example, brightness or color characteristics.

Figure 2:
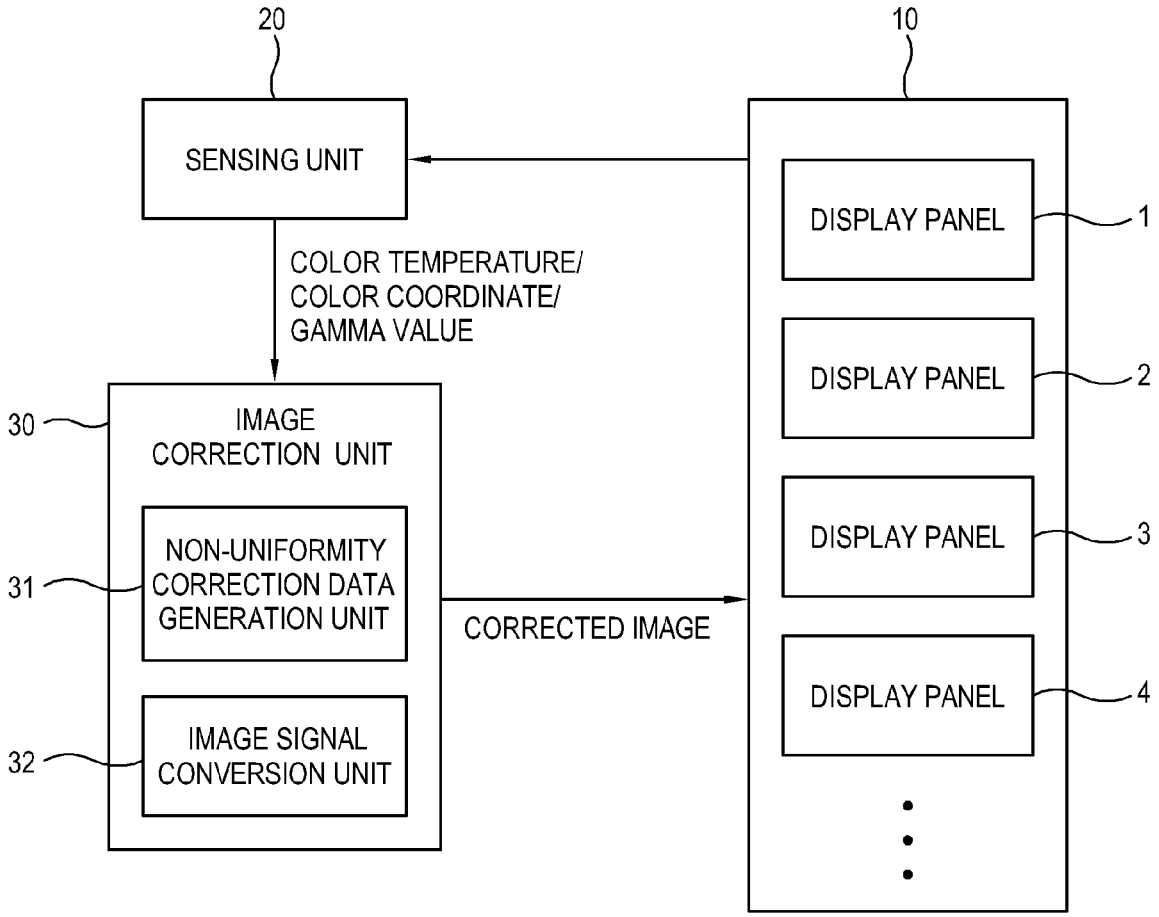
FIG. 2 is a block diagram of the display apparatus according to the exemplary embodiment.

FIG. 2 is a block diagram of a display apparatus according to an exemplary embodiment. As shown in FIG. 2, the display apparatus includes a display unit 10 including a plurality of display panels 1 to 9 arranged adjacently, a sensing unit 20, and an image correction unit 30.

The display unit 10 may include a liquid crystal display (LCD) panel including liquid crystals, an organic light emitting diode (OLED) panel including organic light emitting diodes, or a plasma display panel (PDP), and may include a panel driver driving the panels. The display panels 1 to 9 may include one kind of panel or different kinds of panels. The display panels 1 to 9 may be realized by one kind of display panel in order to easily control an image displayed on the display unit 10 and may be formed of an LCD panel in view of cost, power consumption, and a volume of the display panels 1 to 9. The display panels 1 to 9 may display a single-color image such as a white image or block image in order to correct an image.

The sensing unit 20 may include a photo sensor to sense an image displayed on the display panels 1 to 9 and a module to identify display characteristics of the display panels 1 to 9 on which an image is displayed from information sensed by the photo sensor. The sensing unit 20 may identify the display characteristics while traveling over the display panels 1 to 9 or may be disposed in respective bezels between the display panels 1 to 9. The sensing unit 20 senses a center part of the display panels 1 to 9 to identify a brightness, a color temperature, a color coordinate, and a gamma value of an image displayed on the display panels 1 to 9. Also, the sensing unit 20 senses display characteristics in a plurality of parts of the display panels 1 to 9 and provides an average value or representative value of the display characteristics of the display panels 1 to 9 to the image correction unit 30. As the number of display characteristics sensed by the sensing unit 20 from each of the display panels 1 to 9 or all the display panels 1 to 9 increases, more precise and reliable data is collected to easily control uniformity of the display panels 1 to 9.

The image correction unit 30 generates non-uniformity correction data corresponding to a plurality of areas in each of the display panels 1 to 9 based on the display characteristics output from the sensing unit 20 and interpolates non-uniformity correction data corresponding to a boundary area B being in contact with different display panels 1 to 9 using non-uniformity correction data corresponding to a neighbor area A adjacent the boundary area B. Further, the image correction unit 30 corrects a display characteristic of an image displayed on the display panels 1 to 9 based on the generated and interpolated non-uniformity correction data.

As shown in FIG. 2, the image correction unit 30 includes a non-uniformity correction data generation unit 31 and an image signal conversion unit 32. The non-uniformity correction data generation unit 31 generates at least one of color correction data and brightness correction data as non-uniformity correction data. The color correction data is used to correct a color difference of an image displayed on the display panels 1 to 9, and the brightness correction data is used to correct a brightness difference of an image displayed on the display panels 1 to 9. The image signal conversion unit 32 maps or converts an input image signal into a new image signal using the non-uniformity correction data generated by the non-uniformity correction data generation unit 31.

Figure 3:
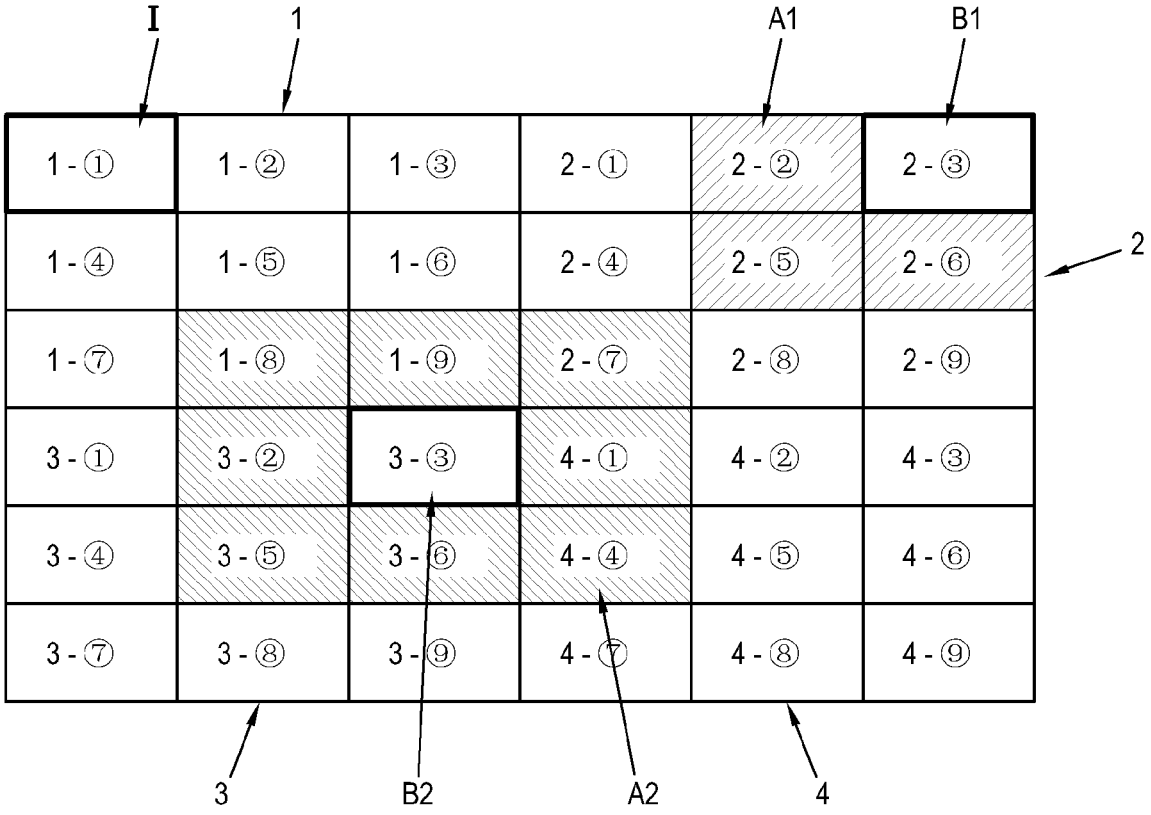
FIG. 3 illustrates image correction between areas of the display apparatus according to the exemplary embodiment.

FIG. 3 illustrates image correction between areas of the display apparatus according to the exemplary embodiment. For convenience, description is made with four display panels 1, 2, 3, and 4 arranged up, down, right, and left as an illustrative example. As shown in FIG. 3, each of the display panels 1, 2, 3, and 4 is divided into a matrix of 3×3 areas I. However, the number of divided areas I is not limited, and each display panel may be divided in 2×2 or more precisely than 3×3. Boundary areas B of one display panel 1, 2, 3, and 4 among the plurality of areas I are adjacent to boundary areas B of another display panel 1, 2, 3, and 4. For example, areas ① to ④ and areas ⑥ to ⑨ of each display panel 1 through 4 correspond to the boundary areas B because each of these areas is adjacent to a corresponding area in a different display panel. For instance, areas ③ through ⑨ of the first display panel 1 are adjacent to the second display panel 2, and areas ⑦ to ⑨ of the first display panel 1 are adjacent to the third display panel 3. Meanwhile, in the present embodiment, an area adjacent to the boundary areas B is defined as a neighbor area A. For example, a neighbor area A1 of an area ③ B1 of the second display panel 2 is areas ②, ⑤, and ⑥ of the second display panel 2. A neighbor area A2 of area ③ B2 of a third display panel 3 is areas ⑧ and ⑨ of the first display panel 1, area ⑦ of the second display panel 2, areas ②, ⑤, and ⑥ of the third display panel 3, and areas ① and ④ of a fourth display panel 4, which encompass the area ③ B2.

Figure 4:
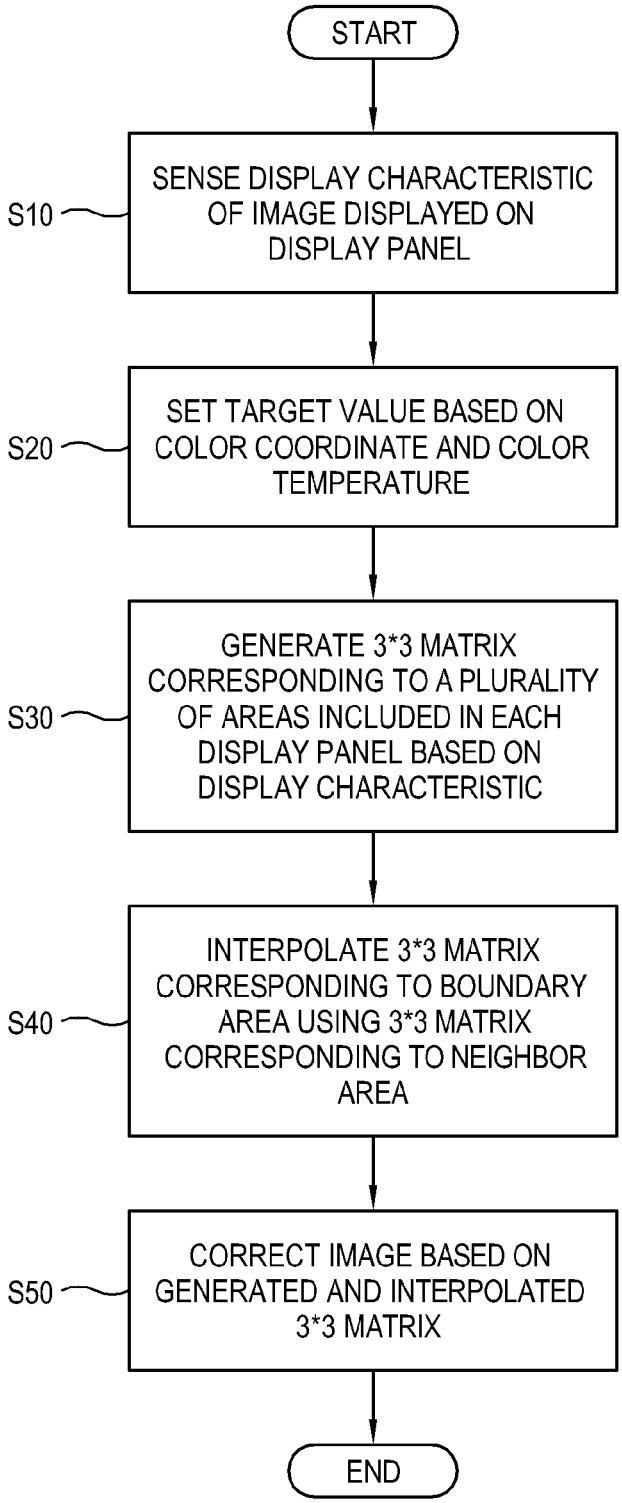
FIG. 4 is a flowchart illustrating an image correction method of the display apparatus according to the exemplary embodiment.

The non-uniformity correction data generation unit 31 according to the present embodiment generates non-uniformity correction data corresponding to each of the plurality of areas I and interpolates non-uniformity correction data of the boundary areas B using the non-uniformity correction data. FIG. 4 is a flowchart illustrating an image correction method of the display apparatus according to the exemplary embodiment, describing a method of generating color correction data among non-uniformity correction data.

First, the sensing unit 20 senses a display characteristic of an image displayed on each of the display panels 1, 2, 3, and 4 (S10).

The non-uniformity correction data generation unit 31 sets the most frequent color coordinate and the most frequent color temperature, or an average color coordinate and an average color temperature among color coordinates and color temperatures of the respective display panels 1, 2, 3, and 4 output from the sensing unit 20 as a target value (xt, yt, Tt) (S20). The target value may be set as tristimulus values (X, Y, Z) based on a color coordinate and a color temperature. That is, the most major color coordinate and the most major color temperature among the color coordinates and the color temperatures of the plurality of display panels 1, 2, 3, and 4 are set as a standard, and a non-uniformity correction data of each of the areas I is generated based on the standard.

Then, the non-uniformity correction data generation unit 31 generates a 3×3 matrix which corresponds to each of the areas I and converts color characteristics of the image into the target value (xt, yt, Tt) based on the display characteristics (S30). An algorithm to obtain a conversion parameter such as the 3×3 matrix may vary and is not limited to a specific one in the present embodiment. A 3×3 matrix to make a representative value (xi, yi, Ti) of a color coordinate and a color temperature sensed in each area the target value (xt, yt, Tt) is as follows.

$$\begin{pmatrix} x_t \\ y_t \\ T_t \end{pmatrix} = \begin{pmatrix} a_{11} & a_{12} & a_{13} \\ a_{21} & a_{22} & a_{23} \\ a_{31} & a_{32} & a_{33} \end{pmatrix} * \begin{pmatrix} x_i \\ y_i \\ T_i \end{pmatrix}$$

The non-uniformity correction data generation unit 31 interpolates a 3×3 matrix as non-uniformity correction data corresponding to a boundary area of each area I, using a 3×3 matrix corresponding to a neighbor area A adjacent to the boundary area B (S40). The area ③ B1 of the second display panel 2 shown in FIG. 3 is interpolated or newly generated using a 3×3 matrix of the neighbor area A1.

In particular, when a neighbor area A2 of area ③ B2 of the third display panel 3 includes areas I of the plurality of display panels 1, 2, 3, and 4, generation of a 3×3 matrix by interpolation of the neighbor area A2 is more effective to solve non-uniformity. When the plurality of display panels 1, 2, 3, and 4 are disposed adjacently, there is a high possibility of occurrence of non-uniformity on a boundary between the display panels 1, 2, 3, and 4 depending on properties of the respective display panels 1, 2, 3, and 4. Thus the non-uniformity correction data generation unit 31 generates non-uniformity correction data for the boundary areas B using non-uniformity correction data of different display panels 1, 2, 3, and 4 from each other.

The non-uniformity correction data generation unit 31 stores the generated and interpolated 3×3 matrix and provides the matrix to the image signal conversion unit 32.

The above processes may be repeated a plurality of times to generate a more precise 3×3 matrix. For example, when the image signal conversion unit 32 corrects an image based on a generated 3×3 matrix, the sensing unit 20 detects a display characteristic of the image again. Then, when a difference between the sensed display characteristic and a target value does not satisfy a predetermined range, a process of obtaining a 3×3 matrix is repeated.

According to another exemplary embodiment, a matrix is not limited to a 3×3 form but may have an m×n (m and n are an integer) shape formed based on sensed display characteristics.

Finally, the image signal conversion unit 32 corrects an input image based on the generated and interpolated 3×3 matrix and displays the image on the display panels 1, 2, 3, and 4 (S50).

Figure 5:
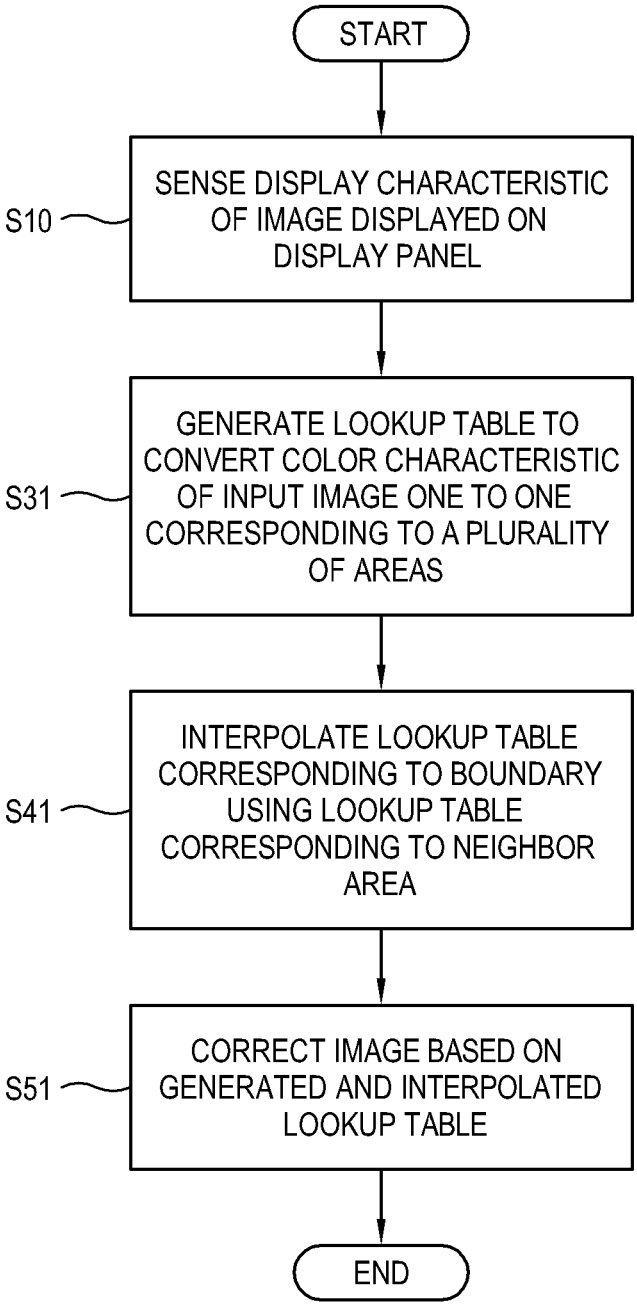
FIG. 5 is a flowchart illustrating an image correction method of a display apparatus according to another exemplary embodiment.

FIG. 5 is a flowchart illustrating an image correction method of a display device according to another exemplary embodiment.

A non-uniformity correction data generation unit 31 according to the present embodiment generates a lookup table to convert a color characteristic of an input image on a one to one basis (S31). The non-uniformity correction data generation unit 31 sets a correction level of R, G, and B in each area based on a display characteristic output from a sensing unit 20. Further, the non-uniformity correction data generation unit 31 generates a lookup table of a gray scale value to adjust a gamma value and a color coordinate corresponding to each area to be a predetermined target gamma value and a predetermined target color coordinate. The non-uniformity correction data generation unit 31 may be realized by a program to generate a lookup table of a color characteristic, that is, a gray scale. When generating the lookup table, unique characteristics of each of the display panels 1, 2, 3, and 4 may be reflected. In addition, when generating the lookup table, instead of generating a lookup table of all gray scale, a lookup table of part of a gray scale is generated, and a lookup table of the remaining of the gray scale may be generated by interpolation.

Then, the non-uniformity correction data generation unit 31 interpolates a lookup table corresponding to a boundary area B among a lookup table of each area I using a lookup table corresponding to a neighbor area A adjacent to the boundary area B (S41).

The image signal conversion unit 32 corrects an input image based on the generated and interpolated lookup table and displays the image on the display panels 1, 2, 3, and 4 (S51).

Figure 6:
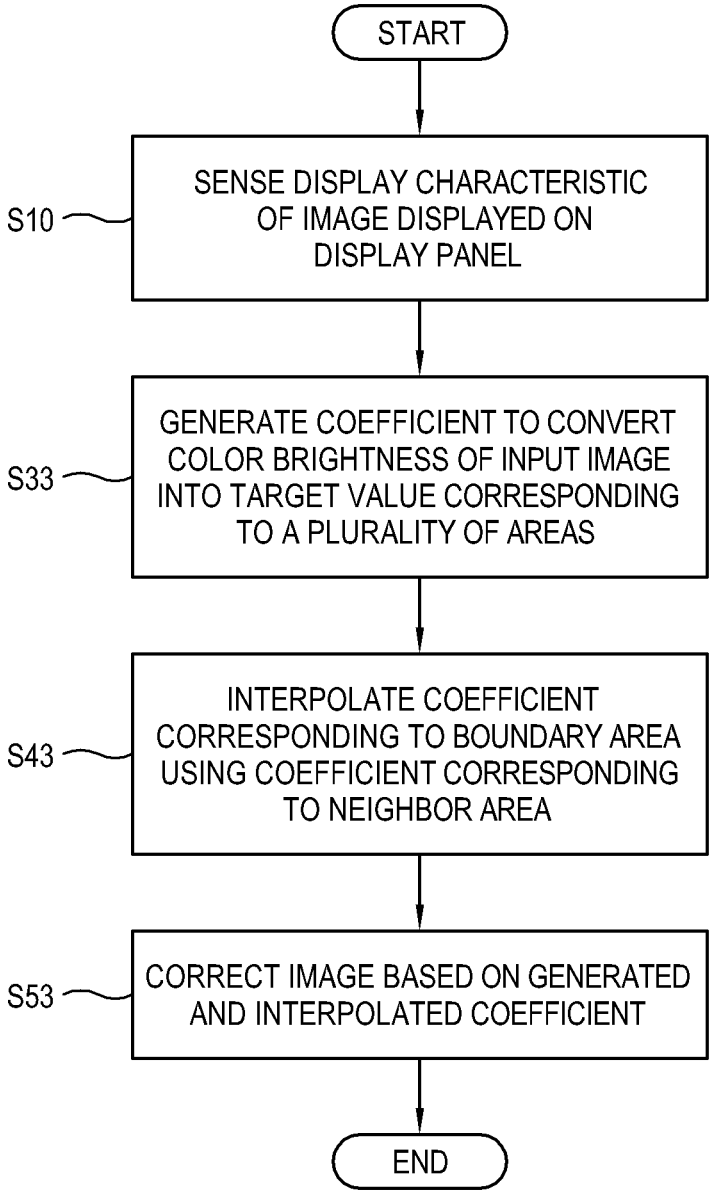
FIG. 6 is a flowchart illustrating an image correction method of a display apparatus according to still another exemplary embodiment.

FIG. 6 is a flowchart illustrating an image correction method of a display apparatus according to still another exemplary embodiment. The present embodiment describes a method of generating brightness correction data to correct a brightness difference of an image.

The sensing unit 20 senses a display characteristic of an image displayed on the display panels (S10). The non-uniformity correction data generation unit 31 according to the present embodiment generates a coefficient to convert a brightness of an input image into a predetermined target value (S33). The non-uniformity correction data generation unit 31 sets a coefficient in each area based on display characteristics, that is, a brightness of an image, output from a sensing unit 20. A target brightness value may be the most frequent brightness value or the lowest brightness value. For example, there is a case where when an image having a brightness of 100 is input, an area ① of a first display panel 1 is sensed to have a brightness of 90, and an area ① of a second display panel 2 is sensed to have a brightness of 95. In this case, the brightness of the area ① of the first display panel 1 of 90, which represents a lower brightness, may become the target brightness value, and a coefficient of the area ① of the second display panel 2 may be set to be 90/95.

Then, the non-uniformity correction data generation unit 31 interpolates a gray scale corresponding to a boundary area B among a gray scale of each area I using a gray scale corresponding to a neighbor area A adjacent to the boundary area B (S43).

The image signal conversion unit 32 corrects an image in the same process as the above (S53).

The display apparatus may perform color correction after brightness correction or perform brightness correction after color correction. Also, only either one of color correction and brightness correction may be performed as long as uniformity is improved.

Alternatively, a brightness of a backlight unit may be adjusted based on non-uniformity correction data instead of an image signal. When the display panels 1 to 9 include an LCD panel, an image's display characteristics may be changed by light emitted from the backlight unit. Thus, the light emitted from the backlight unit is controlled to control the display characteristics of the image uniformly. In particular, when the backlight unit includes three colors of light emitting diodes, light may be controlled by the colors, thereby efficiently controlling the display characteristics.

Although a few exemplary embodiments have been shown and described, it will be appreciated by those skilled in the art that changes may be made in these exemplary embodiments without departing from the principles and spirit of the invention, the scope of which is defined in the appended claims and their equivalents.

What is claimed is:

1. A display apparatus comprising:

a plurality of display panels;

a sensing unit which includes a sensor and which senses a display characteristic of an image displayed on at least one of the plurality of display panels; and an image correction unit which generates non-uniformity correction data corresponding to a plurality of areas included in each of the plurality of display panels based on the display characteristic, interpolates the generated non-uniformity correction data corresponding to a boundary area of a first display panel of the plurality of display panels, which is in contact with a second display panel of the plurality of display panels, using the generated non-uniformity correction data corresponding to a neighbor area adjacent to the boundary area, and corrects the image displayed on the at least one of the plurality of display panels based on the generated and interpolated non-uniformity correction data, wherein the image correction unit calculates the generated non-uniformity correction data corresponding to at least two selected from among the neighbor areas adjacent to the boundary area.

2. The display apparatus of claim 1, wherein at least one of the generated and interpolated non-uniformity correction data comprises at least one of color correction data and brightness correction data, wherein the color correction data corrects a color difference of the image displayed on the at least one of the plurality of display panels and the brightness correction data corrects a brightness difference of the image displayed on the at least one of the plurality of display panels.

3. The display apparatus of claim 2, wherein the color correction data comprises a 3×3 matrix, and wherein the image correction unit converts a color characteristic of an input image into a predetermined target value using the 3×3 matrix.

4. The display apparatus of claim 3, wherein the sensing unit senses color coordinates of the plurality of display panels, and the image correction unit sets one of a most frequent color coordinate and an average color coordinate among the sensed color coordinates as the target value.

5. The display apparatus of claim 4, wherein the sensing unit senses color temperatures of the plurality of display panels, and the image correction unit sets the target value as a tristimulus value comprising one of a most frequent color coordinate and an average color coordinate, and one of a most frequent color temperature and an average color temperature among the sensed temperatures.

6. The display apparatus of claim 3, wherein the sensing unit senses color temperatures of the plurality of display panels, and the image correction unit sets one of a most frequent color temperature and an average color temperature among the sensed color temperatures as the target value.

7. The display apparatus of claim 2, wherein the color correction data comprises a lookup table, and wherein the image correction unit converts a color characteristic of an input image on a one to one basis.

8. The display apparatus of claim 2, wherein the brightness correction data comprises a coefficient, and wherein the image correction unit converts a brightness of an input image into a predetermined target value using the coefficient.

9. The display apparatus of claim 1, wherein the image correction unit interpolates the generated the non-uniformity correction data corresponding to the boundary area based on a contact between the boundary area and the neighbor area.

10. An image correction method of a display apparatus which comprises a plurality of display panels, the method comprising:

sensing, by a sensing unit which includes a sensor, a display characteristic of an image displayed on at least one of the plurality of display panels;

generating non-uniformity correction data corresponding to a plurality of areas included in each of the plurality of display panels based on the display characteristic;

interpolating the generated non-uniformity correction data corresponding to a boundary area of a first display panel of the plurality of display panels, which is in contact with a second display panel of the plurality of display panels, using the generated non-uniformity correction data corresponding to a neighbor area adjacent to the boundary area; and correcting the image displayed on the at least one of the plurality display panels based on the generated and interpolated non-uniformity correction data, wherein the image correction unit calculates the generated non-uniformity correction data corresponding to at least two selected from among the neighbor areas adjacent to the boundary area.

11. The method of claim 10, wherein the generating the non-uniformity correction data comprises at least one of generating color correction data and generating brightness correction data, wherein the correcting comprises correcting a color difference of the image displayed on the at least one of the plurality of display panels using the color correction data, and correcting a brightness difference of the image displayed on the at least one of the plurality of display panels using the brightness correction data.

12. The method of claim 10, wherein the generating the non-uniformity correction data comprises generating a 3×3 matrix to convert a color characteristic of an input image into a predetermined target value.

13. The method of claim 12, wherein the sensing the display characteristic comprises sensing color coordinates of the plurality of display panels, and the generating the non-uniformity correction data comprises setting one of a most frequent color coordinate and an average color coordinate among the sensed color coordinates as the target value.

14. The method of claim 13, wherein the sensing the display characteristic comprises sensing color temperatures of the plurality of display panels, and the generating the non-uniformity correction data comprises setting the target value as a tristimulus value comprising one of a most frequent color coordinate and an average color coordinate, and one of a most frequent color temperature and an average color temperature among the sensed color temperatures.

15. The method of claim 12, wherein the sensing the display characteristic comprises sensing color temperatures of the plurality of display panels, and the generating the non-uniformity correction data comprises setting one of a most frequent color temperature and an average color temperature among the sensed color temperatures as the target value.

16. The method of claim 10, wherein the generating the non-uniformity correction data comprises generating a lookup table to convert a color characteristic of an input image on a one to one basis.

17. The method of claim 10, wherein the generating the non-uniformity correction data comprises generating a coefficient to convert a brightness of an input image into a predetermined target value.

18. The method of claim 10, wherein the interpolating the generated the non-uniformity correction data interpolates the generated the non-uniformity correction data corresponding to the boundary area based on a contact between the boundary area and the neighbor area.

* * * * *